US009289991B2

(12) United States Patent
Yamamoto

(10) Patent No.: US 9,289,991 B2
(45) Date of Patent: Mar. 22, 2016

(54) INKJET HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Keizaburo Yamamoto, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/011,935

(22) Filed: Aug. 28, 2013

(65) Prior Publication Data

US 2014/0085381 A1 Mar. 27, 2014

(30) Foreign Application Priority Data

Sep. 24, 2012 (JP) ..... 2012-209685

(51) Int. Cl.

*B41J 2/18* (2006.01)
*B41J 2/14* (2006.01)
*B41J 2/16* (2006.01)

(52) U.S. Cl.

CPC ..... *B41J 2/1433* (2013.01); *B41J 2/14209* (2013.01); *B41J 2/1609* (2013.01); *B41J 2/1621* (2013.01); *B41J 2/1623* (2013.01);
(Continued)

(58) Field of Classification Search

CPC .... B41J 2/1433; B41J 2/14209; B41J 2/1609; B41J 2/1621; B41J 2/1623; B41J 2/1632; B41J 2/1634; B41J 2002/14217; B41J 2202/12

USPC ..... 347/58, 68, 89, 85

See application file for complete search history.

(56) References Cited

U.S. PATENT DOCUMENTS 6,415,507 B1 * 7/2002 Shimosato et al. ..... 29/890.1
2001/0024214 A1 * 9/2001 Takahashi et al. ..... 347/11

(Continued)

FOREIGN PATENT DOCUMENTS

JP 2002-052712 2/2002
JP 2006-082396 3/2006

(Continued)

OTHER PUBLICATIONS

Japanese Office Action for Japanese Patent Application No. 2012-209685 mailed on May 13, 2014.

*Primary Examiner* — Stephen Meier
*Assistant Examiner* — Alexander D Shenderov
(74) *Attorney, Agent, or Firm* — Amin, Turocy & Watson, LLP

(57) ABSTRACT

According to one embodiment, an inkjet head includes a base, a driving element, a nozzle plate, electrodes, wires, a supplying unit, and a discharging unit. The base includes an attachment surface and a side surface crossing the attachment surface. The driving element is attached to the attachment surface and includes pressure chambers. The nozzle plate is attached to the driving element and includes nozzles opened to the pressure chambers. The electrodes are provided in the pressure chambers. The wires are provided on the side surface and connected to the electrodes. The supplying unit is connected to the pressure chambers and supplies ink to the pressure chambers. The discharging unit is connected to the pressure chambers and discharges the ink from the pressure chambers.

13 Claims, 6 Drawing Sheets

(52) U.S. Cl.
CPC ..... *B41J 2/1632* (2013.01); *B41J 2/1634* (2013.01); *B41J 2002/14217* (2013.01); *B41J 2202/12* (2013.01)

(56) References Cited

U.S. PATENT DOCUMENTS

2003/0156165 A1* 8/2003 Sakaida ..... 347/68
2008/0036823 A1* 2/2008 Tanuma ..... 347/70
2009/0015640 A1* 1/2009 Nishida et al. ..... 347/85
2009/0284569 A1 11/2009 Kawaguchi et al.

FOREIGN PATENT DOCUMENTS

JP 2007-175921 7/2007
JP 2008-094036 4/2008
JP 2010-284908 12/2010
JP 2011-167846 9/2011

* cited by examiner

INKJET HEAD

CROSS-REFERENCE TO RELATED APPLICATION

This application is based upon and claims the benefit of priority from Japanese Patent Application No. 2012-209685, filed Sep. 24, 2012, the entire contents of which are incorporated herein by reference.

FIELD

Embodiments described herein relate generally to an inkjet head and a manufacturing method for the inkjet head.

BACKGROUND

An inkjet head of a so-called side shooter type includes a base plate and a driving element attached to the base plate. The driving element is located in an ink chamber closed by a nozzle plate. The driving element ejects, from nozzles provided in the nozzle plate, ink supplied to the ink chamber.

The base plate is formed of a hard material such as high-purity alumina. A plurality of holes for supplying the ink to the ink chamber and discharging the ink from the ink chamber are provided in the base plate.

Wires connected to the driving elements are provided in the base plate. A driving circuit is connected to the wires. The driving circuit applies a voltage to the driving element via the wires. The driving element applied with the voltage is deformed and ejects the ink from the nozzles.

If the base plate is formed of a soft material, it is likely that the base plate is damaged by the holes provided in the base plate. Therefore, the material of the base plate could be limited to a material having fixed or higher hardness.

DETAILED DESCRIPTION

In general, according to one embodiment, an inkjet head includes a base, a driving element, a nozzle plate, a plurality of electrodes, a plurality of wires, a supplying unit, and a discharging unit. The base includes an attachment surface and a side surface crossing the attachment surface. The driving element is attached to the attachment surface and includes a plurality of pressure chambers. The nozzle plate is attached to the driving element and includes a plurality of nozzles respectively opened to the plurality of pressure chambers. The plurality of electrodes are respectively provided in the plurality of pressure chambers. The plurality of wires are provided on the side surface and respectively connected to the plurality of electrodes. The supplying unit is connected to the plurality of pressure chambers and supplies ink to the pressure chambers.

The discharging unit is connected to the plurality of pressure chambers and discharges the ink from the pressure chambers.

A first embodiment is explained below with reference to FIGS. 1 to 5. Components that can be indicated by a plurality of expressions are sometimes indicated by examples of one or more other expressions. This does not deny that components not indicated by other expressions are indicated by different expressions and does not limit components from being indicated by other expressions not illustrated herein.

Figure 1:
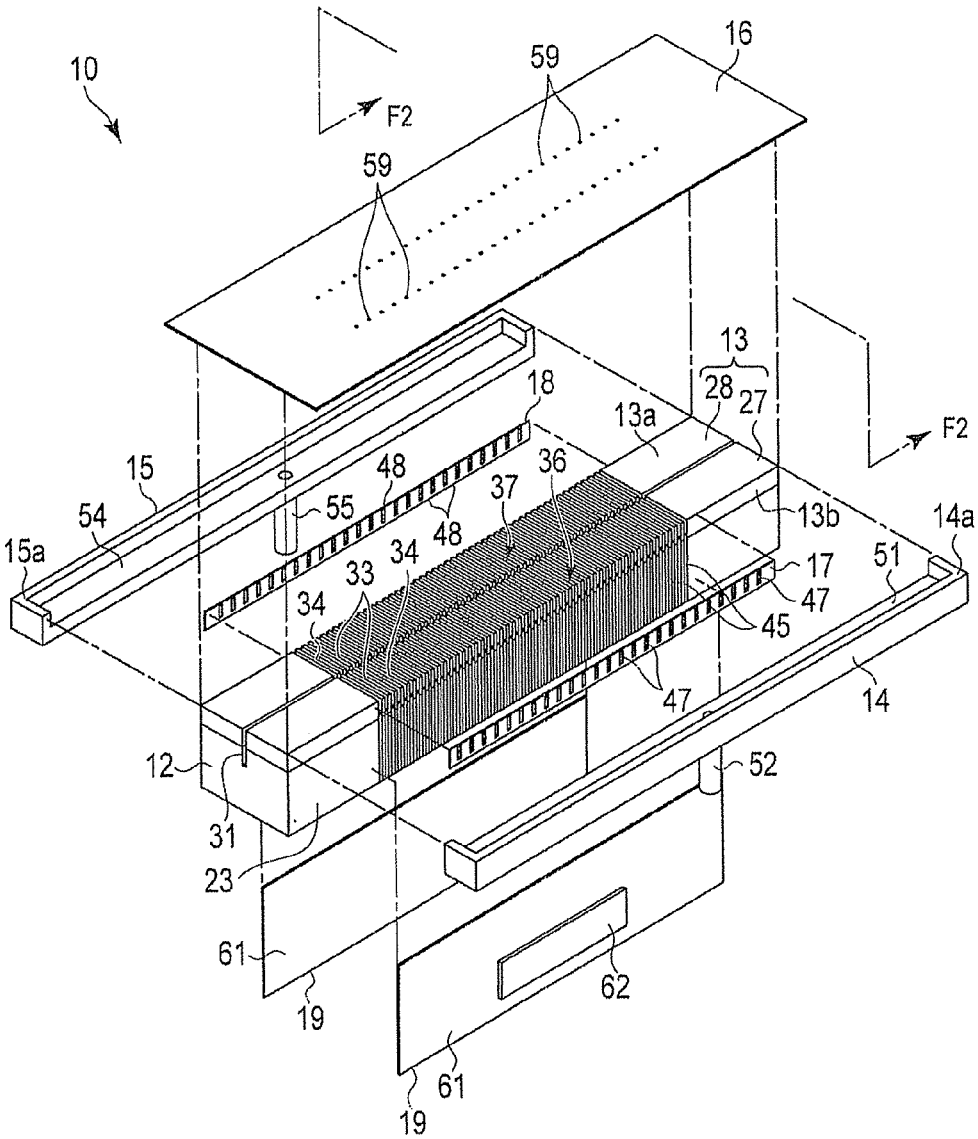
FIG. 1 is an exploded perspective view showing an inkjet head according to a first embodiment.
Figure 2:
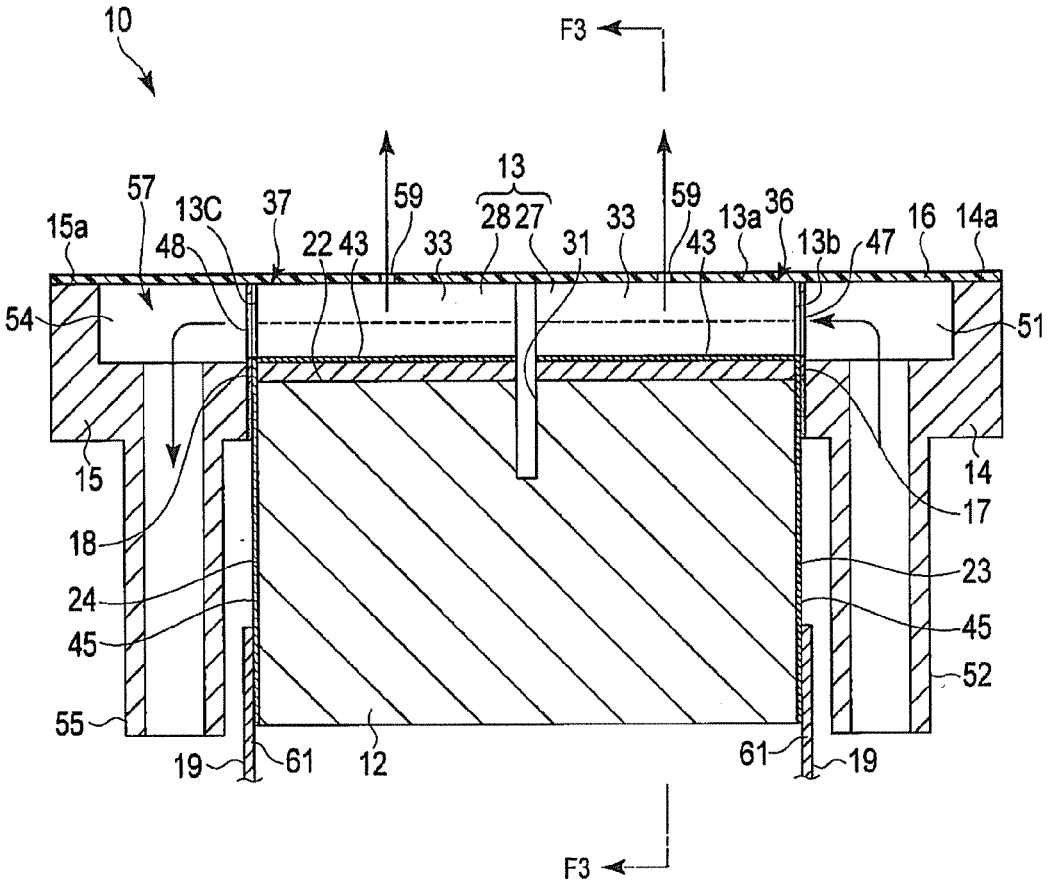
FIG. 2 is a sectional view showing the inkjet head along line F2-F2 in FIG. 1.
Figure 3:
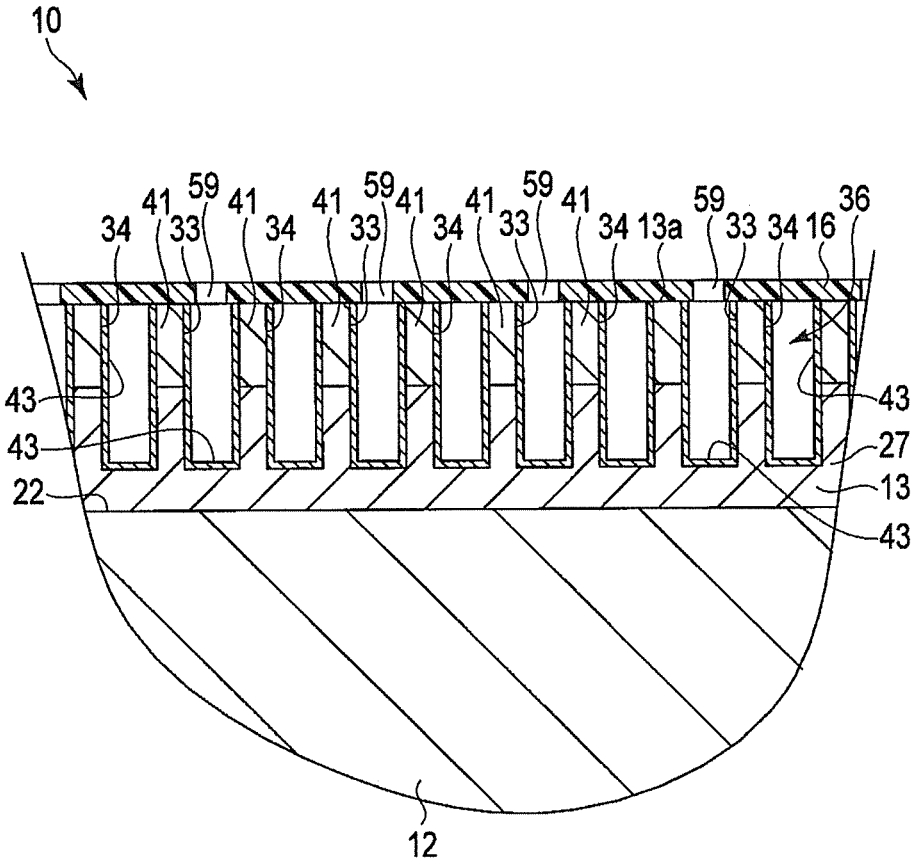
FIG. 3 is a sectional view showing the inkjet head along line F3-F3 in FIG. 2.

FIG. 1 is an exploded perspective view of an inkjet head 10 according to the first embodiment. FIG. 2 is a perspective view showing the inkjet head 10 along line F2-F2 in FIG. 1. FIG. 3 is a sectional view showing the inkjet head 10 along line F3-F3 in FIG. 2. As shown in FIG. 1, the inkjet head 10 is an inkjet head of a so-called side shooter type.

The inkjet head 10 includes a base member 12, an actuator 13, a first manifold 14, a second manifold 15, a nozzle plate 16, a first wall section 17, a second wall section 18, and a pair of circuit boards 19. The base member 12 is an example of the base. The actuator 13 is an example of the driving element. The first manifold 14 is an example of the supplying unit. The second manifold 15 is an example of the discharging unit. The circuit boards 19 are an example of the driving circuit.

The base member 12 is formed in a rectangular bar shape. The base member 12 is formed of a material such as low-purity alumina. The base member 12 is excellent in heat conduction.

As shown in FIG. 2, the base member 12 includes an attachment surface 22, a first side surface 23, and a second side surface 24. The first and second side surfaces 23 and 24 are an example of the side surface. The attachment surface 22 and the first and second side surfaces 23 and 24 are formed flat.

The first side surface 23 is orthogonal to the attachment surface 22. The second side surface 24 is orthogonal to the attachment surface 22 and located on the opposite side of the first side surface 23. The first and second side surfaces 23 and 24 may cross the attachment surface 22 at other angles (e.g., 60°).

In other words, an end of the attachment surface 22 is integral with an end of the first side surface 23 inclined with respect to the attachment surface 22. The other end of the attachment surface 22 is integral with an end of the second side surface 24 inclined with respect to the attachment surface 22. In other words, the first and second side surfaces 23 and 24 are bent with respect to the attachment surface 22. Grooves, projections, components, or the like may be arranged between the attachment surface 22 and the first and second side surfaces 23 and 24.

The actuator 13 is attached to the attachment surface 22 by, for example, an adhesive. The actuator 13 covers substantially the entire region of the attachment surface 22. A part of the attachment surface 22 may be exposed. The actuator 13 is formed of a piezoelectric material such as lead zirconate titanate (PZT).

The actuator 13 includes a first portion 27 and a second portion 28. The first and second portions 27 and 28 are formed in a rectangular plate shape. The first and second portions 27 and 28 are arranged side by side in parallel to each other along the longitudinal direction of the base member 12.

A dividing groove 31 is provided between the first portion 27 and the second portion 28. The dividing groove 31 is provided to extend from the actuator 13 to the base member 12 and divides the first portion 27 and the second portion 28. In other words, the depth of the dividing groove 31 is larger than the thickness of the actuator 13. The dividing groove 31 may be provided only in a part of the actuator 13. The first portion 27 and the second portion 28 may be integral.

Both ends of the dividing groove 31 are closed by plates or resin. Therefore, the ink supplied to the inkjet head 10 is prevented from leaking to the outside from the dividing groove 31.

Figure 4:
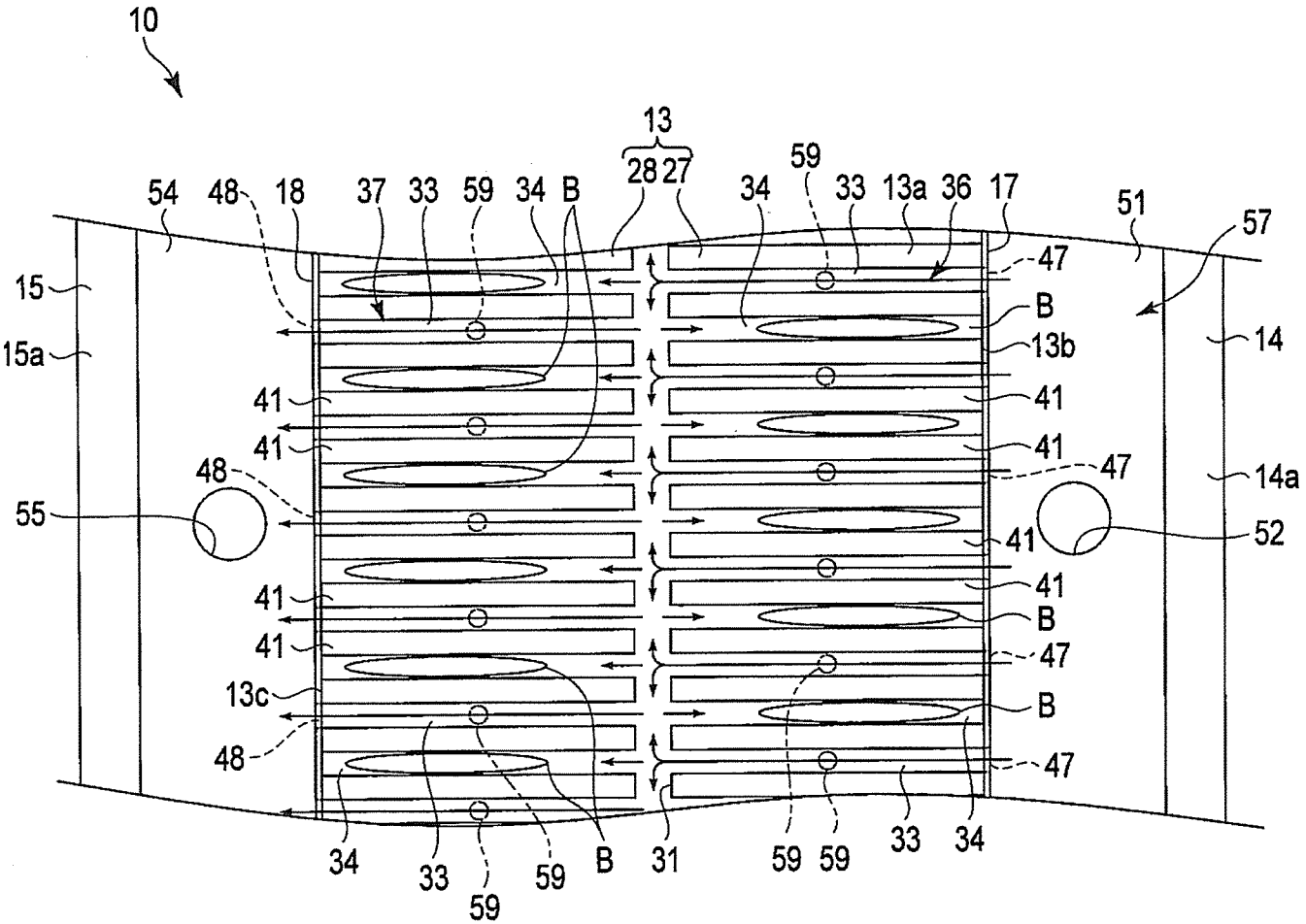
FIG. 4 is a plan view showing the inkjet head.

FIG. 4 is a plan view showing the inkjet head 10 excluding the nozzle plate 16. As shown in FIG. 4, a plurality of pressure chambers 33 and a plurality of air chambers 34 are respectively provided in the first and second portions 27 and 28 of the actuator 13. The pressure chambers 33 and the air chambers 34 are respectively formed in groove shapes extending in a direction crossing the longitudinal direction of the actuator 13. The pressure chambers 33 and the air chambers 34 are opened on a top surface 13*a* and left and right side surfaces 13*b* and 13*c* of the actuator 13. The pressure chambers 33 and the air chambers 34 are alternately arranged and arranged side by side in parallel to each other.

As shown in FIG. 1, the plurality of pressure chambers 33 and the plurality of air chambers 34 provided in the first portion 27 form a first row 36. The plurality of pressure chambers 33 and the plurality of air chambers 34 provided in the second portion 28 form a second row 37. The second row 37 is arranged in parallel to the first row 36. The pressure chambers 33 and the air chambers 34 included in the first row 36 and the pressure chambers 33 and the air chambers 34 included in the second row 37 are separated by the dividing groove 31. The width of the dividing groove 31 is larger than the width of the pressure chamber 33 and larger than the width of the air chamber 34.

As shown in FIG. 4, the pressure chambers 33 and the air chambers 34 included in the first row 36 are shifted with respect to the pressure chambers 33 and the air chambers 34 included in the second row 37. That is, the pressure chambers 33 included in the first row 36 are adjacent to the air chambers 34 included in the second row 37. The air chambers 34 included in the first row 36 are adjacent to the pressure chambers 33 included in the second row 37.

As shown in FIG. 3, a plurality of column sections 41 are respectively formed between the pressure chambers 33 and the air chambers 34. The plurality of column sections 41 partition the pressure chambers 33 and the air chambers 34 and form side surfaces of the pressure chambers 33.

Electrodes 43 are respectively provided in the pressure chambers 33 and the air chambers 34. The electrodes 43 cover the side surfaces and the bottom surfaces of the pressure chambers 33 and the air chambers 34. The electrodes 43 are formed of, for example, a nickel thin film. However, the material of the electrodes 43 is not limited to this. The electrodes 43 may be formed of, for example, gold or copper.

As shown in FIG. 1, a plurality of wiring patterns 45 are provided on the first and second side surfaces 23 and 24 of the base member 12. The wiring patterns 45 are an example of the wires. The plurality of wiring patterns 45 are formed of, for example, a nickel thin film subjected to laser pattering. The wiring patterns 45 may be formed of, for example, gold or copper.

As shown in FIG. 2, the plurality of wiring patterns 45 extend from the ends of the first and second side surfaces 23 and 24 toward the actuator 13. The plurality of wiring patterns 45 are respectively connected to the plurality of electrodes 43.

The first wall section 17 is attached to the first side surface 23 of the base member 12 and the side surface 13*b* of the actuator 13. The first wall section 17 is formed of, for example, a film made of resin excellent in ink resistance. The ink resistance indicates a degree of damage to a material immersed in the ink for a fixed time.

The first wall section 17 includes a plurality of first holes 47. The plurality of first holes 47 are respectively opened to the plurality of pressure chambers 33 (included in the first row 36) provided in the first portion 27. On the other hand, the first wall section 17 closes portions of the air chambers 34 opened on the side surface 13*b* of the actuator 13.

The second wall section 18 is attached to the second side surface 24 of the base member 12 and the side surface 13*c* of the actuator 13. The second wall section 18 is formed of, for example, a film made of resin excellent in ink resistance.

The second wall section 18 includes a plurality of second holes 48. The plurality of second holes 48 are respectively opened to the plurality of pressure chambers 33 (included in the second row 37) provided in the second portion 28. On the other hand, the second wall portion 18 closes portions of the air chambers 34 opened on the side surface 13*c* of the actuator 13.

The first manifold 14 is a component for supplying the ink to the pressure chambers 33. The first manifold 14 is attached to the first side surface 23 of the base member 12 and the side surface 13*b* of the actuator 13. The first manifold 14 bonded to the first side surface 23, for example, via the wiring patterns 45 provided on the first side surface 23. Therefore, the first wall section 17 is interposed between the actuator 13 and the first manifold 14.

The first manifold 14 includes a first channel 51 and a supply pipe 52. The first channel 51 is opened toward the first portion 27 of the actuator 13. The first channel 51 is connected to the plurality of pressure chambers 33 of the first portion 27 via the plurality of first holes 47 of the first wall section 17. The supply pipe 52 is coupled to the first channel 51. The supply pipe 52 is connected to, for example, an ink tank via piping such as a tube.

The first manifold 14 includes a top surface 14*a* that is flush with the top surface 13*a* of the actuator 13. The first channel 51 is opened on the top surface 14*a* of the first manifold 14. The tope surface 14*a* may be closed.

The second manifold 15 is a component for discharging the ink from the pressure chambers 33. The second manifold 15 is attached to the second side surface 24 of the base member 12 and the side surface 13*c* of the actuator 13. The second manifold 15 is bonded to the second side surface 24, for example, via the wiring patterns 45 provided on the second side surface 24. Therefore, the second wall section 18 is interposed between the actuator 13 and the second manifold 15.

The second manifold 15 includes a second channel 54 and a discharge pipe 55. The second channel 54 is opened toward the second portion 28 of the actuator 13. The second channel 54 is connected to the plurality of pressure chambers 33 of the second portion 28 via the plurality of second holes 48 of the second wall section 18. The discharge pipe 55 is coupled to the second channel 54. The discharge pipe 55 is connected to the ink tank via piping such as a tube.

The second manifold 15 includes a top surface 15*a* that is flush with the top surface 13*a* of the actuator 13. The second channel 54 is opened on the top surface 15*a* of the second manifold 15. The top surface 15*a* may be closed.

The nozzle plate 16 is formed of, for example, a rectangular film made of polyimide. The material of the nozzle plate 16 is not limited to polyimide. The nozzle plate 16 may be formed of another material that can be micromachined by a laser. The nozzle plate 16 is also referred to as orifice plate.

The nozzle plate 16 is attached to the top surface 13*a* of the actuator 13, the top surface 14*a* of the first manifold 14, and the top surface 15*a* of the second manifold 15 by, for example, an adhesive. Consequently, an ink chamber 57 is formed. The ink chamber 57 is a chamber formed by the actuator 13, the first manifold 14, the second manifold 15, and the nozzle plate 16. The ink chamber 57 includes the first and second channels 51 and 54. The nozzle plate 16 closes a part of the pressure chambers 33 and the air chambers 34 opened on the top surface 13*a* of the actuator 13.

The nozzle plate 16 includes a plurality of nozzles 59. The plurality of nozzles 59 are provided to correspond to the plurality of pressure chambers 33 and respectively opened to the plurality of pressure chambers 33. In FIG. 4, the nozzles 59 are indicated by alternate long and two short dashes lines. As shown in FIG. 4, the plurality of nozzles 59 are arranged side by side in two rows.

As shown in FIG. 1, the pair of circuit boards 19 respectively include flexible printed circuit boards (FPCs) 61 and ICs 62. The ICs 62 are mounted on the FPCs 61. The FPCs 61 include wires and various components such as capacitors. The FPCs 61 are thermally compression-bonded and connected to the wiring patterns 45 by, for example, anisotropic conductive films (ACFs). The circuit boards 19 are not limited to this and may be tape carrier packages (TCPs).

The inkjet head 10 ejects the ink, for example, as explained below. As indicated by an arrow in FIG. 2, first, the ink in the ink tank is supplied to the first channel 51 through the supply pipe 52 by, for example, a pump.

As indicated by arrows in FIG. 4, the ink is supplied to the plurality of pressure chambers 33 of the first portion 27 through the first holes 47 of the first wall section 17. The ink is prevented by the first wall section 17 and does not flow into the air chambers 34 from the first channel 51.

The ink supplied to the pressure chambers 33 of the first portion 27 is supplied to the pressure chambers 33 of the second portion 28 through the dividing groove 31. The ink flows into the second channel 54 through the second holes 48 of the second wall section 18.

As indicated by small arrows in FIG. 4, a part of the ink sometimes flows into the air chambers 34 of the first and second portions 27 and 28. However, since the air chambers 34 are closed by the first and second wall sections 17 and 18, the ink less easily flows into the air chambers 34. Therefore, air B is present in the air chambers 34. Gas other than the air B may be present in the air chambers 34.

As indicated by an arrow in FIG. 2, the ink flown into the second channel 54 is discharged to the ink tank through the discharge pipe 55. The ink returned to the ink tank is supplied to the inkjet head 10 through the supply pipe 52 again. In this way, the ink circulates between the inkjet head 10 and the ink tank.

The ICs 62 apply a driving signal (voltage) to the electrodes 43 of the pressure chambers 33 via the FPCs 61 and the wiring patterns 45. When the voltage is applied to the electrodes 43, the column sections 41 defining the pressure chambers 33 are deformed in a shear mode. According to the deformation of the column sections 41, the capacity of the pressure chambers 33 changes and the ink supplied to the pressure chambers 33 is pressurized. The pressurized ink is ejected from the nozzles 59.

Figure 5:
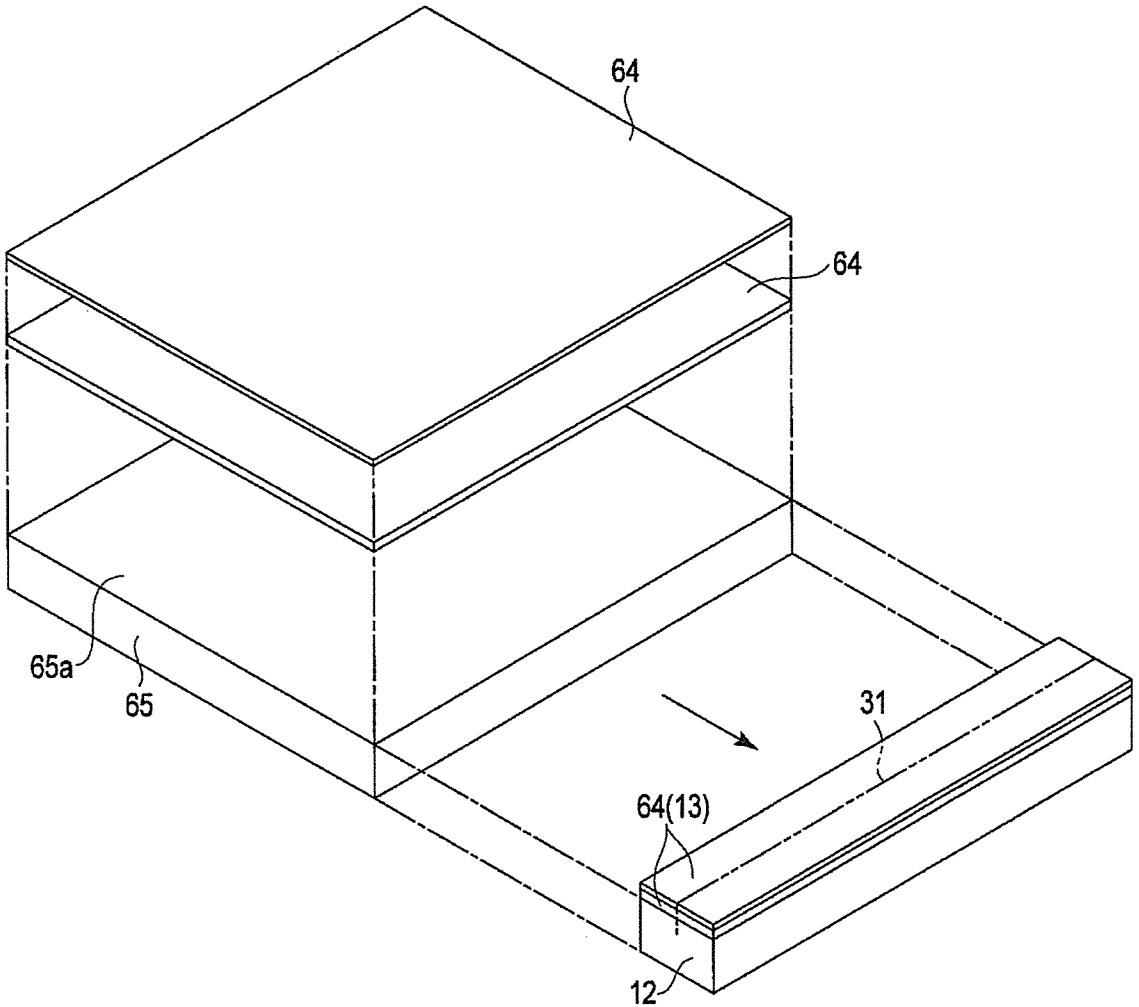
FIG. 5 is a perspective view showing a base member and an actuator in a manufacturing process in the first embodiment.

An example of a manufacturing method of the inkjet head 10 is explained. FIG. 5 is a perspective view showing the base member 12 and the actuator 13 in a manufacturing process. First, a pair of piezoelectric members 64 forming the actuator 13 are stuck together to set polarization directions thereof in opposite directions. The piezoelectric members 64 are formed of the piezoelectric material such as PZT in a plate shape.

The stuck-together piezoelectric member 64 is bonded to a base material 65 forming the base member 12. The base material 65 is formed of the low-purity alumina in a plate shape. The piezoelectric member 64 is attached to an upper surface 65*a* of the base material 65 forming the attachment surface 22 of the base member 12.

Subsequently, the piezoelectric member 64 and the base material 65 are divided to have width equivalent to the channel length of the pressure chambers 33 (two rows of the pressure chambers 33). In other words, the base member 12 and the actuator 13 are cut out from the piezoelectric member 64 and the base material 65. In the base member 12 and the actuator 13 shown in FIG. 5, a place where the dividing groove 31 is provided is indicated by an alternate long and two short dashes line.

Subsequently, the plurality of pressure chambers 33 and the plurality of air chambers 34 are formed in the piezoelectric member 64 (the actuator 13). The pressure chambers 33 and the air chambers 34 are formed by cutting the piezoelectric member 64 using, for example, a diamond wheel of a dicing saw used for cutting an IC wafer.

Subsequently, the dividing groove 31 is formed in the base member 12 and the actuator 13. The dividing groove 31 is formed by cutting the base member 12 and the actuator 13 using the diamond wheel of the dicing saw. The dividing groove 31 may be formed earlier than the pressure chambers 33 and the air chambers 34.

Subsequently, the electrodes 43 are formed in the pressure chambers 33 and the air chambers 34 and, at the same time, the wiring patterns 45 are formed on the first and second side surfaces 23 and 24 of the base member 12. The electrodes 43 and the wiring patterns 45 are formed using, for example, an electroless plating method. The nickel thin films are removed from regions other than the electrodes 43 and the wiring patterns 45 by, for example, performing patterning through laser irradiation.

Subsequently, the first and second wall sections 17 and 18 are attached to the first and second side surfaces 23 and 24 of the base member 12 and the side surfaces 13*b* and 13*c* of the actuator 13. The first and second manifolds 14 and 15 are attached to the first and second side surfaces 23 and 24 of the base member 12 and the side surfaces 13*b* and 13*c* of the actuator 13.

Subsequently, the top surface 13*a* of the actuator 13, the top surface 14*a* of the first manifold 14, and the top surface 15*a* of the second manifold 15 are machined to be flush with one another by, for example, polishing. The polishing does not have to be performed. The nozzle plate 16 is attached to the actuator 13 and the first and second manifolds 14 and 15.

Subsequently, the circuit boards 19 are respectively connected to the wiring patterns 45 provided on the first and second side surfaces 23 and 24. Consequently, the inkjet head 10 shown in FIG. 1 is formed.

In the inkjet head 10 having the configuration explained above, the wiring patterns 45 are provided on the first and second side surfaces 23 and 24 of the base member 12. Consequently, a space for attaching the circuit boards 19 is unnecessary in the width direction of the inkjet head 10. The inkjet head 10 can be reduced in size. In other words, the width of the inkjet head 10 can be reduced. Further, the thickness of the inkjet head 10 can be reduced by the thickness of the wiring patterns 45.

The first and second manifolds 14 and 15 for supplying the ink to the pressure chambers 33 and discharging the ink from the pressure chambers 33 are provided separately from the base member 12. Consequently, holes or the like through which the ink passes do not need to be provided in the base member 12. Therefore, the base member 12 does not need to be formed of a hard material. The material of the base member 12 can be selected from a wider range.

Since the base member 12 may be formed of a soft material, for example, a tool for forming the dividing groove 31 can be suppressed from being damaged or deteriorated during machining. Therefore, manufacturing costs for the base member 12 can be reduced.

Since it is unnecessary to provide holes or the like in the first and second side surfaces 23 and 24, the wiring patterns 45 can be formed linearly. Consequently, the wiring patterns 45 can be easily formed. As explained above, the inkjet head 10 has satisfactory manufacturability.

The first and second rows 36 and 37 of the pressure chambers 33 are separated by the dividing groove 31. The pressure chambers 33 of the first row 36 and the pressure chambers 33 of the second row 37 are close to each other. Consequently, the inkjet head 10 can be reduced in size. Further, the first and second portions 27 and 28 do not need to be separately attached to the base member 12. The rows of the pressure chambers 33 can be separated by dividing the piezoelectric member 64 using a cutter or the like. Therefore, the inkjet head 10 can be easily manufactured.

The pressure chambers 33 and the air chambers 34 are alternately provided by the first and second wall sections 17 and 18. Consequently, when the ink is ejected from the pressure chambers 33, resistance is suppressed from being caused in the chambers (the air chambers 34) adjacent to one another. Consequently, a driving frequency of the inkjet head 10 can be increased.

The pressure chambers 33 and the air chambers 34 included in the first row 36 are shifted with respect to the pressure chambers 33 and the air chambers 34 included in the second row 37. Consequently, residual vibration can be suppressed from being propagated between the pressure chambers 33 included in the first row 36 and the pressure chambers 33 included in the second row 37.

The width of the dividing groove 31 is larger than the width of the pressure chamber 33. Consequently, the ink can easily move from the pressure chambers 33 of the first row 36 to the pressure chambers 33 of the second row 37 through the dividing groove 31.

A second embodiment is explained with reference to FIG. 6. In the embodiment disclosed below, components having functions same as the functions of the components of the inkjet head 10 in the first embodiment are denoted by the same reference numerals and signs. Further, explanation of the components is partially or entirely omitted.

Figure 6:
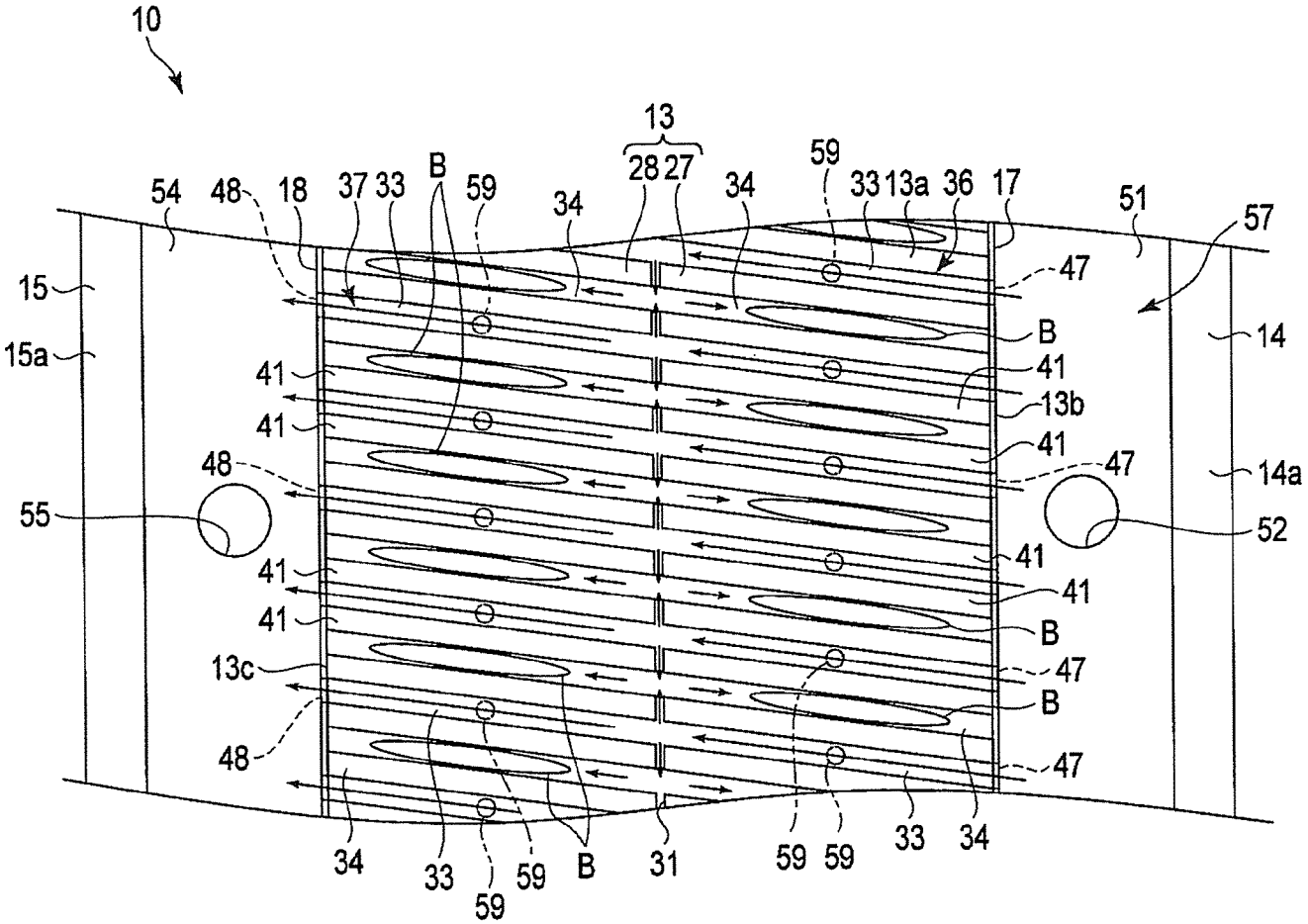
FIG. 6 is a plan view showing an inkjet head according to a second embodiment.

FIG. 6 is a plan view showing the inkjet head 10 according to the second embodiment excluding the nozzle plate 16. As shown in FIG. 6, in the second embodiment, the width of the dividing groove 31 is smaller than the width of the pressure chamber 33 and smaller than the width of the air chamber 34.

The pressure chambers 33 and the air chambers 34 included in the first row 36 are aligned with the pressure chambers 33 and the air chambers 34 included in the second row 37. That is, the pressure chambers 33 included in the first row 36 are adjacent to the pressure chambers 33 included in the second row 37. The air chambers 34 included in the first row 36 are adjacent to the air chambers 34 included in the second row 37.

In the second embodiment, ink is supplied to the ink chamber 57 as explained below. First, when the ink is supplied to the first channel 51, the ink is supplied to the plurality of pressure chambers 33 of the first portion 27 through the first holes 47 of the first wall section 17. The ink is prevented by the first wall section 17 and does not flow into the air chambers 34 from the first channel 51.

The ink supplied to the pressure chambers 33 of the first portion 27 is supplied to the pressure chambers 33 of the second portion 28 adjacent to the pressure chambers 33. The ink flows into the second channel 54 through the second holes 48 of the second wall section 18.

As indicated by small arrows in FIG. 6, a part of the ink sometimes flows into the air chambers 34 of the first and second portions 27 and 28 through the dividing groove 31. However, since the air chambers 34 are closed by the first and second wall sections 17 and 18, the ink less easily flows into the air chambers 34. Further, since the width of the dividing groove 31 is smaller than the width of the pressure chamber 33, the ink less easily passes through the dividing groove 31. Therefore, the air B is present in the air chambers 34.

In the inkjet head 10 in the second embodiment, the width of the dividing groove 31 is smaller than the width of the pressure chamber 33. Consequently, the ink in the pressure chambers 33 less easily flows into the air chambers 34 through the dividing groove 31. The air B tends to remain in the air chambers 34. Therefore, when the ink is ejected from the pressure chambers 33, it is possible to further suppress resistance from being caused in chambers (the air chambers 34) adjacent to the pressure chambers 33.

In at least one of the inkjet heads explained above, the wires are provided on the side surface of the base. The side surface crosses the attachment surface of the base to which the driving element is attached. Consequently, it is possible to provide the inkjet head having satisfactory manufacturability.

While certain embodiments have been explained, these embodiments have been presented by way of example only, and are not intended to limit the scope of the inventions. The novel embodiments can be embodied in a variety of other forms. Various omissions, substitutions, and changes can be made without departing from the spirit of the inventions. The embodiments and modifications thereof are included in the scope and the gist of the invention and included in the inventions described in claims and a scope of equivalents of the inventions.

For example, the inkjet head 10 does not have to include the first and second wall sections 17 and 18. When the first and second wall sections 17 and 18 are absent, the inkjet heat 10 obtains high-density and high-definition printing performance by, for example, controlling an ejecting method of the ink.

What is claimed is:

1. An inkjet head comprising:

a base plate including an attachment surface and first and second side surfaces each of which cross the attachment surface;

a driving element attached to the attachment surface and including a plurality of pressure chambers, a bottom surface of each pressure chamber being positioned away from the attachment surface;

a nozzle plate attached to the driving element and including a plurality of nozzles respectively opened to the plurality of pressure chambers;

a plurality of electrodes respectively provided in the plurality of pressure chambers;

a plurality of wires provided on each of the first and second side surfaces and respectively connected to the plurality of electrodes;

a supplying unit including a first manifold, the first manifold being independent of the base plate, arranged in an outside of the first side surface of the base plate, attached to the first side surface via the plurality of wires and connected to the plurality of pressure chambers to supply the plurality of pressure chambers with ink; and a discharging unit including a second manifold, the second manifold being independent of the base plate, arranged in an outside of the second side surface of the base plate, attached to the second side surface via the plurality of wires and connected to the plurality of pressure chambers to discharge the ink from the pressure chambers.

2. The inkjet head according to claim 1, wherein the plurality of pressure chambers form a first row and a second row parallel to the first row, and the plurality of pressure chambers included in the first row and the pressure chambers included in the second row are separated by a dividing groove provided in the driving element.

3. The inkjet head according to claim 2, further comprising:

a first wall section interposed between the driving element and the supplying unit and including a plurality of first holes opened to the plurality of pressure chambers; and a second wall section interposed between the driving element and the discharging unit and including a plurality of second holes opened to the plurality of pressure chambers, wherein the driving element further includes a plurality of air chambers closed by at least one of the first wall section and the second wall section and arranged alternately with the plurality of pressure chambers.

4. The inkjet head according to claim 3, wherein the first manifold of the supplying unit extends along a whole of the first side wall of the base plate in a direction along which the pressure chambers are arranged in the based plate, and the second manifold of the discharging unit extends along a whole of the second side wall of the base plate in the direction along which the pressure chambers are arranged in the based plate.

5. The inkjet head according to claim 4, wherein the first manifold of the supplying unit includes an ink supply pipe which is arranged apart from the first side surface of the base plate in the outside of the first side surface, the ink supply pipe extending along the first side surface and supplying the first manifold of the supplying unit with the ink, and the second manifold of the discharging unit includes an ink discharge pipe which is arranged apart from the second side surface of the base plate in the outside of the second side surface, the ink discharge pipe extending along the second side surface and discharging the ink from the second manifold of the discharging unit.

6. The inkjet head according to claim 5, wherein the ink supply pipe is arranged at a center of the first manifold of the supplying unit in a direction along which the first manifold of the supplying unit extends, and the ink discharge pipe is arranged at a center of the second manifold of the discharging unit in a direction along which the second manifold of the discharging unit extends.

7. The inkjet head according to claim 1, further comprising:

a first wall section interposed between the driving element and the supplying unit and including a plurality of first holes opened to the plurality of pressure chambers; and a second wall section interposed between the driving element and the discharging unit and including a plurality of second holes opened to the plurality of pressure chambers, wherein the driving element further includes a plurality of air chambers closed by at least one of the first wall section and the second wall section and arranged alternately with the plurality of pressure chambers.

8. The inkjet head according to claim 7, wherein the first manifold of the supplying unit extends along a whole of the first side wall of the base plate in a direction along which the pressure chambers are arranged in the based plate, and the second manifold of the discharging unit extends along a whole of the second side wall of the base plate in the direction along which the pressure chambers are arranged in the based plate.

9. The inkjet head according to claim 8, wherein the first manifold of the supplying unit includes an ink supply pipe which is arranged apart from the first side surface of the base plate in the outside of the first side surface, the ink supply pipe extending along the first side surface and supplying the first manifold of the supplying unit with the ink, and the second manifold of the discharging unit includes an ink discharge pipe which is arranged apart from the second side surface of the base plate in the outside of the second side surface, the ink discharge pipe extending along the second side surface and discharging the ink from the second manifold of the discharging unit.

10. The inkjet head according to claim 9, wherein the ink supply pipe is arranged at a center of the first manifold of the supplying unit in a direction along which the manifold of the supplying unit extends, and the ink discharge pipe is arranged at a center of the second manifold of the discharging unit in a direction along which the second manifold of the discharging unit extends.

11. The inkjet head according to claim 1, wherein the first manifold of the supplying unit extends along a whole of the first side wall of the base plate in a direction along which the pressure chambers are arranged in the based plate, and the second manifold of the discharging unit extends along a whole of the second side wall of the base plate in the direction along which the pressure chambers are arranged in the based plate.

12. The inkjet head according to claim 11, wherein the first manifold of the supplying unit includes an ink supply pipe which is arranged apart from the first side surface of the base plate in the outside of the first side surface, the ink supply pipe extending along the first side surface and supplying the first manifold of the supplying unit with the ink, and the second manifold of the discharging unit includes an ink discharge pipe which is arranged apart from the second side surface of the base plate in the outside of the second side surface, the ink discharge pipe extending along the second side surface and discharging the ink from the second manifold of the discharging unit.

13. The inkjet head according to claim 12, wherein the ink supply pipe is arranged at a center of the first manifold of the supplying unit in a direction along which the manifold of the supplying unit extends, and the ink discharge pipe is arranged at a center of the second manifold of the discharging unit in a direction along which the manifold of the discharging unit extends.

* * * * *